US005570781A

United States Patent [19]

Bond et al.

[11] Patent Number: 5,570,781

[45] Date of Patent: Nov. 5, 1996

[54] CONTAINER FOR RETAINING DISPLAYING MEDIA DISCS

[75] Inventors: Charles F. Bond, Lake Worth, Fla.; Tracy L. Kassera, Plymouth; Keith W. Lockwood, Minneapolis, both of Minn.

[73] Assignee: Slash Corporation, Edina, Minn.

[21] Appl. No.: 317,700

[22] Filed: Oct. 5, 1994

[51] Int. Cl.[6] ..... B65D 85/57

[52] U.S. Cl. ..... 206/308.1; 206/485

[58] Field of Search ..... 206/307.1, 308.1, 206/308.3, 309, 387.15, 425, 485

[56] References Cited

U.S. PATENT DOCUMENTS

| | | | |
|---|---|---|---|
| 1,303,299 | 5/1919 | Hahl . | |
| 1,420,004 | 6/1922 | Weide . | |
| 2,354,872 | 8/1944 | Mitnick . | |
| 3,009,622 | 11/1961 | Leone | 206/485 |
| 3,927,761 | 12/1975 | Boyle | 206/485 X |
| 4,307,809 | 12/1981 | Haswell . | |
| 4,538,730 | 9/1985 | Wu . | |
| 4,588,086 | 5/1986 | Coe . | |
| 4,627,535 | 12/1986 | Kirchner et al. | 206/425 X |
| 4,676,372 | 6/1987 | Rager . | |
| 4,676,374 | 6/1987 | Wilkins . | |
| 4,776,457 | 10/1988 | Ferraroni . | |
| 4,778,047 | 10/1988 | Lay . | |
| 4,883,171 | 11/1989 | Carlton . | |
| 5,114,014 | 5/1992 | Ascalon et al. . | |
| 5,148,942 | 9/1992 | Snook | 206/425 X |
| 5,307,926 | 5/1994 | Mee . | |

OTHER PUBLICATIONS

International Search Report issued in corresponding PCT International Application No. PCT/US95/12813, (3 pp.), dated Feb. 14, 1996.

*Primary Examiner*—Jacob K. Ackun

*Attorney, Agent, or Firm*—Mueting, Raasch, Gebhardt & Schwappach, P.A.

[57] ABSTRACT

A disc support structure formed from a sheet material having at least one pair of opposing side walls separated a fixed distance by a back wall. At least one pair of laterally aligned, opposing slots are located on the opposing side walls for receiving and retaining edges of a media disc. The pair of opposing slots may be angled relative to the back wall so that a surface of the media disc is visible through a display plane. The disc support structure may be inserted into an outer housing for packaging purposes.

14 Claims, 8 Drawing Sheets

CONTAINER FOR RETAINING DISPLAYING MEDIA DISCS

FIELD OF THE INVENTION

The present invention relates to a disc support structure for media discs, and in particular, a disc container utilizing a disc support structure for packaging media discs.

BACKGROUND OF THE INVENTION

Media discs containing digital information, such as software, audio and visual presentations, etc., are increasingly becoming commodity items subject to downward pricing pressures. These discs have traditionally been sold in a hard plastic package known as a "jewel case". While the jewel case package has proven effective for protecting the media disc, they add considerable expense to the cost of the disc. Additionally, the jewel cases are heavy and bulky, making it awkward to package multiple media discs. Finally, although the cover of the jewel case is general constructed of a transparent plastic, the aesthetics of the media disc are diminished when so packaged. Therefore, there is a need for a lightweight, low cost package for transporting and displaying multiple media discs in a manner that protects the disc from damage and is aesthetically pleasing to consumers.

SUMMARY OF THE INVENTION

The present invention is directed to a disc support structure formed from a sheet material having at least one pair of opposing side walls separated a fixed distance by a back wall. At least one pair of laterally aligned, opposing slots are located on the opposing side walls for receiving and retaining edges of a media disc. The pair of opposing slots preferably are angled relative to the back wall so that a surface of the media disc is visible through a display plane. Displaying the media discs at an angle has the added advantage of allowing multiple discs to be display in a relatively thin package. In another embodiment, the sheet material is formed so as to have two pairs of generally opposing side walls.

The sheet material comprises paperboard, plastic or any other suitable material. The disc carrier preferably is retained in an outer housing, also constructed of paperboard, plastic, or other suitable semirigid material. The outer housing preferably has a display window approximate the display plane for viewing the media discs.

The opposing side walls are generally parallel. In an alternate embodiment, the side walls may be disposed as various angles relative to one another. The opposing side walls may contain a plurality of opposing slots for receiving multiple media discs.

Edge portions are formed adjacent to the opposing side walls proximate the display plane to create edge buffers. The edge buffers maintain the separation between the discs and provide shock absorbing capabilities during transport.

The slots may be extend only across a portion of the opposing side walls. Alternatively, the slot may extend through the front edge of the side walls to facilitate insertion of the media discs into the disc support structure.

The present inventions is also directed to a method of manufacturing a disc support structure for simultaneously retaining and displaying media discs. A plurality of forming lines are located on a sheet material such that the forming lines define the pair of opposing side walls separated by a back wall. Laterally aligned slots are cut into the side wall so that they are angled relative to the back wall when the opposing sidewalls are formed. The sheet material is then formed along the forming lines to define a disc support structure. Edge portions are also preferably formed on the front edges of the opposing side walls. The forming process may include forming the sheet material or molding it according to the above structure.

DETAILED DESCRIPTION OF THE PREFERRED EMBODIMENT

Figure 1:
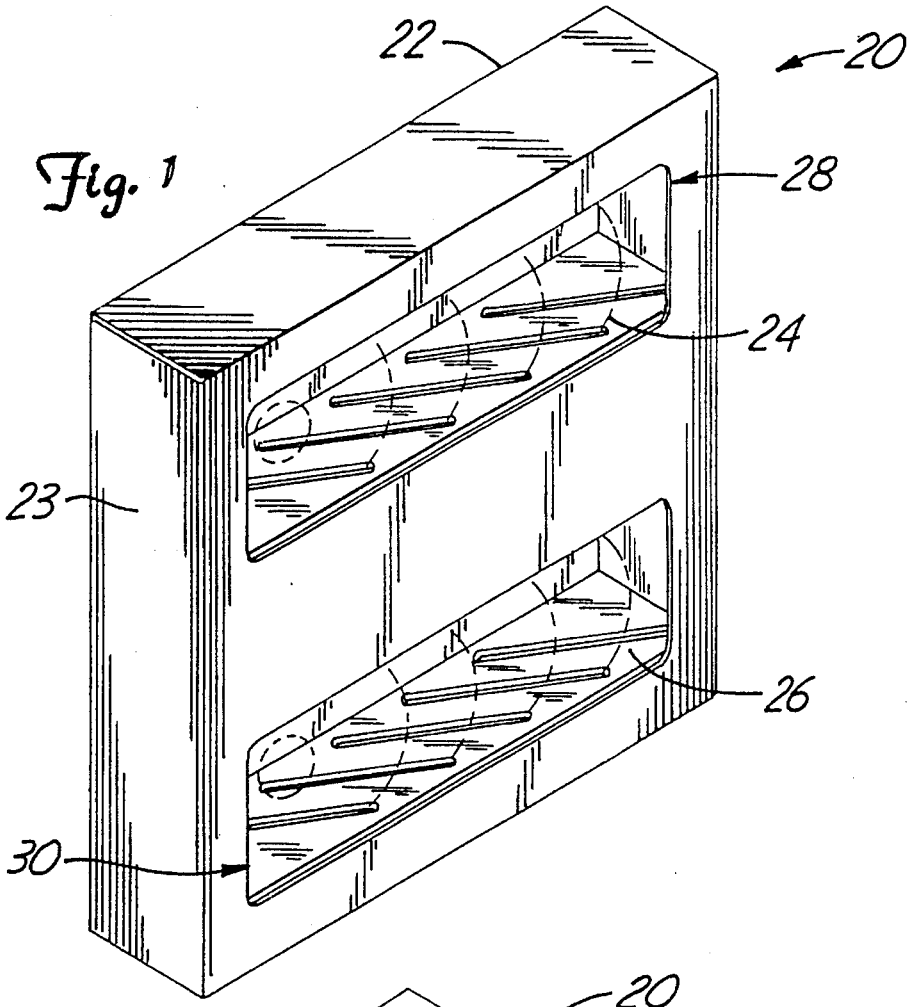
FIG. 1 is a view in perspective view of a disc support structure retained in an outer housing with the discs shown in phantom as seen from the top, front and one side.
Figure 2:
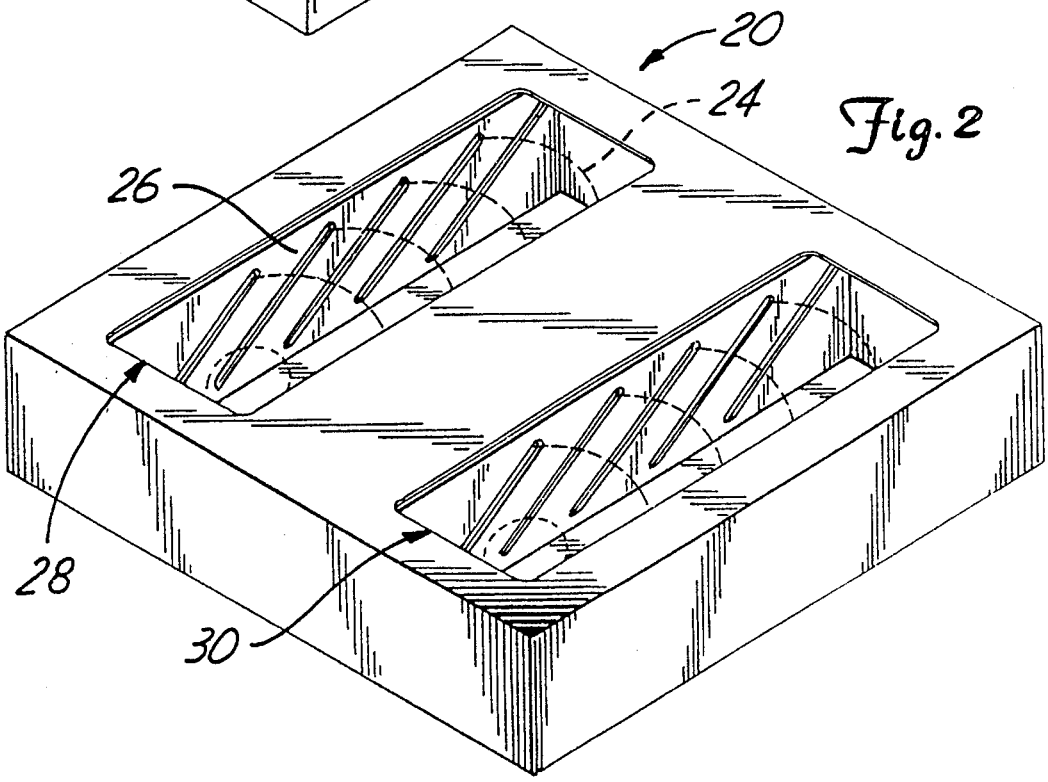
FIG. 2 is a view in perspective as seen from the front, side and bottom.
Figure 3:
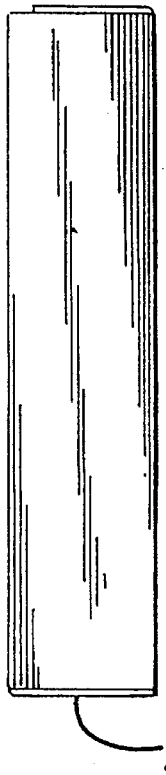
FIG. 3 is a view in top plan.
Figure 4:
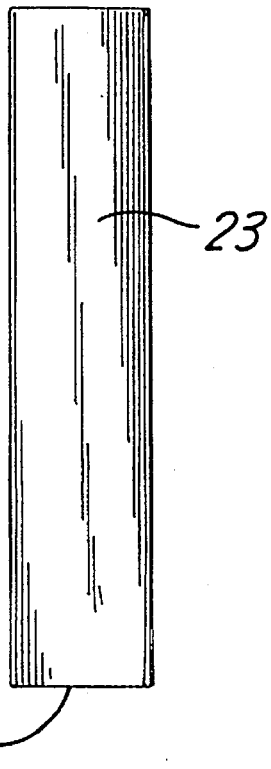
FIG. 4 is a side elevation as seen from the side in FIG. 1.
Figure 5:
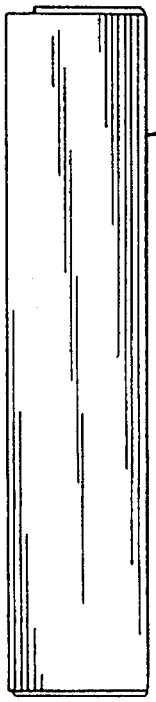
FIG. 5 is a view in bottom plan.

FIGS. 1 and 2 illustrate a disc container 20 having a disc support structure 26 contained within an outer housing 22. A plurality of media discs 24 are suspended and retained by the disc support structure 26 within the outer housing 22. The outer housing 22 preferably has first and second display windows 28, 30 through which the media discs 24 may be viewed. A folding door 23 is provided through which the disc support structure can be inserted and removed from the outer housing 22 (see also FIG. 4).

Figure 6:
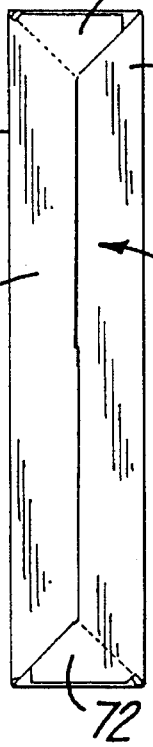
FIG. 6 is a side elevation as seen from a side opposite FIG. 4.

FIGS. 3 through 6 illustrate side views of the outer housing 22 of FIG. 1. As is seen in FIG. 6, flaps 66, 68, 70, 72 are interleaved to form the side 25 opposite the folding door 23, as is known in conventional box technology. The outer housing 22 may be constructed of paperboard, plastic, or any other semi-rigid packaging material.

Figure 7:
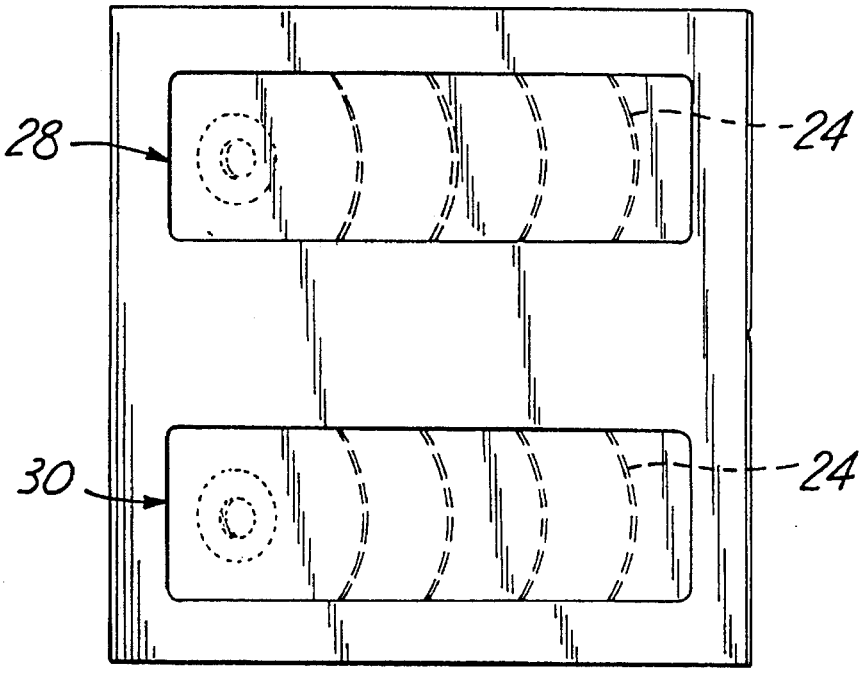
FIG. 7 is a front plan.
Figure 8:
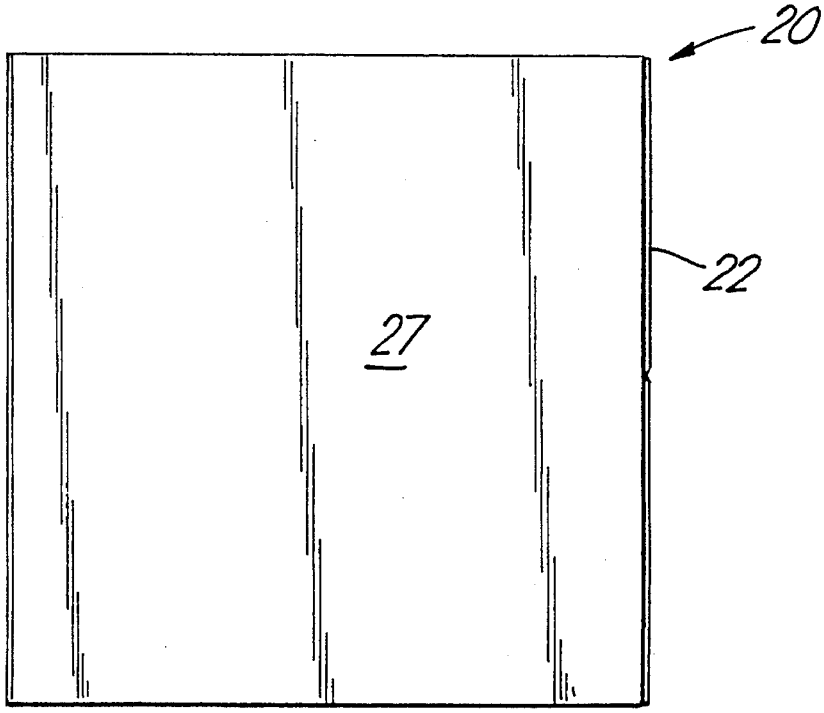
FIG. 8 is a rear plan.
Figure 15:
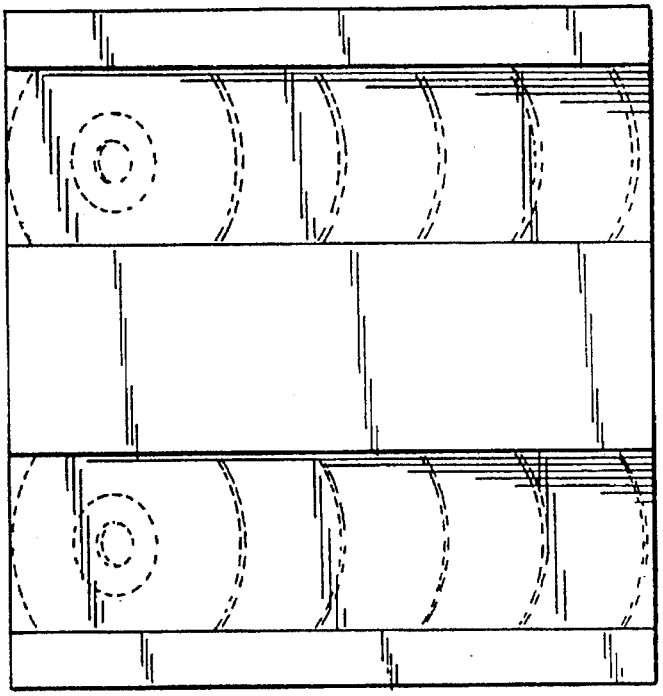
FIG. 15 is a side elevation as seen from the side opposite that shown in FIG. 13.

As illustrated in FIG. 7, the opposing slots (see FIGS. 9 and 10) are staggered so that a portion of each media discs 24 is visible through the display windows 28, 30. (see also FIG. 15). FIG. 8 illustrates a rear view of the disc container 20 illustrated in FIG. 1. It will be understood that rear wall 27 of the outer housing 22 may also include one or more display windows.

Figure 9:
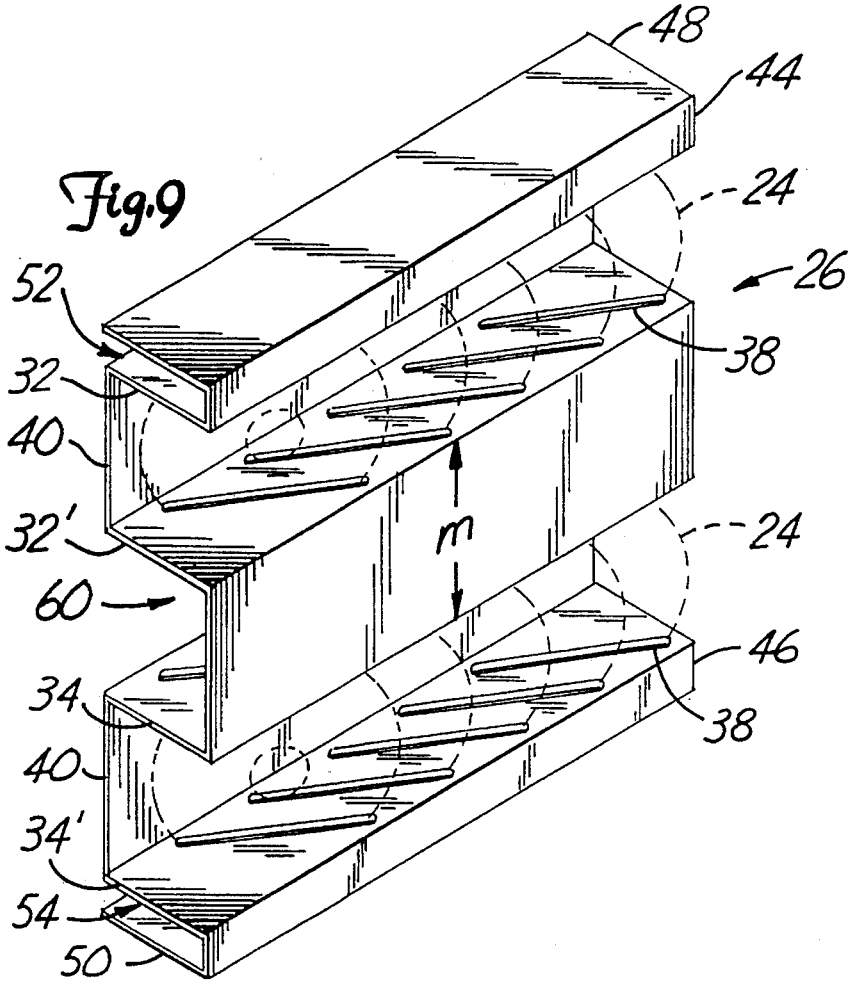
FIG. 9 is a view in perspective of a disc support structure as seen from the top and two sides with the discs shown in phantom.
Figure 10:
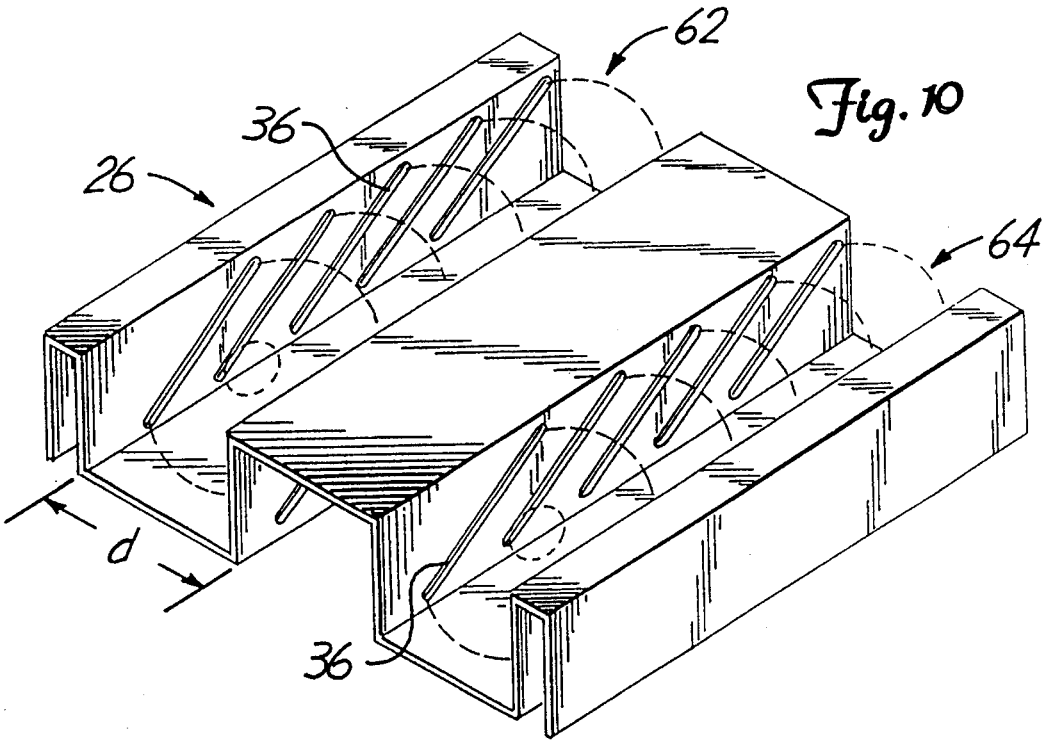
FIG. 10 is a view in perspective as seen from the bottom and two sides.
Figure 11:
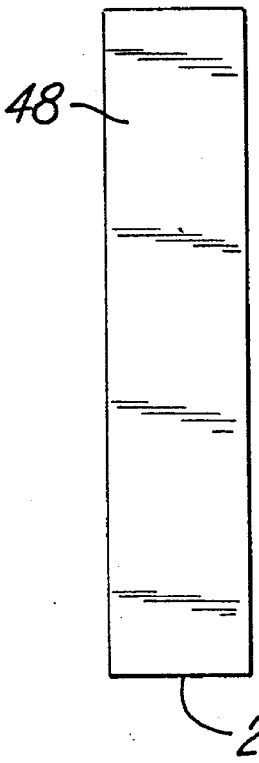
FIG. 11 is a view in top plan.
Figure 14:
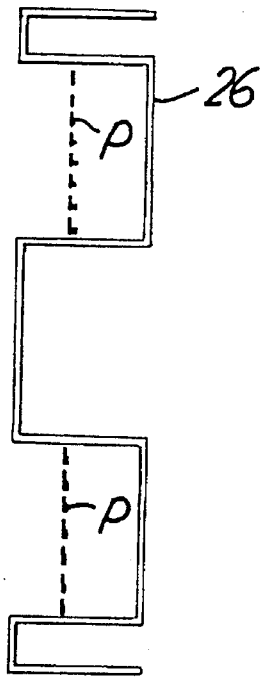
FIG. 14 is a side elevation as seen from right to left of FIG. 13.

The disc support structure 26, as best seen in FIGS. 9 and 10, has two pairs of opposing side walls 32, 32' 34, 34'. The side wall 32, 32', 34, 34' each have a plurality of opposing slots 36, 38 for engaging with edges of the media discs 24. A display plane "p" through which the discs 24 may be viewed is defined across the separation between the side walls 32, 32', 34, 34' (see FIG. 14).

The opposing side walls 32, 32', 34, 34' are separated a fixed distance "d" by a back wall 40. The distance "d" is selected based on the diameter of the discs 24. A middle support 42 maintains the separation "m" between the two rows 62, 64 of discs 24. The separation "m" must be sufficient to prevent the edges of the media discs 24 from contacting.

Figure 16:
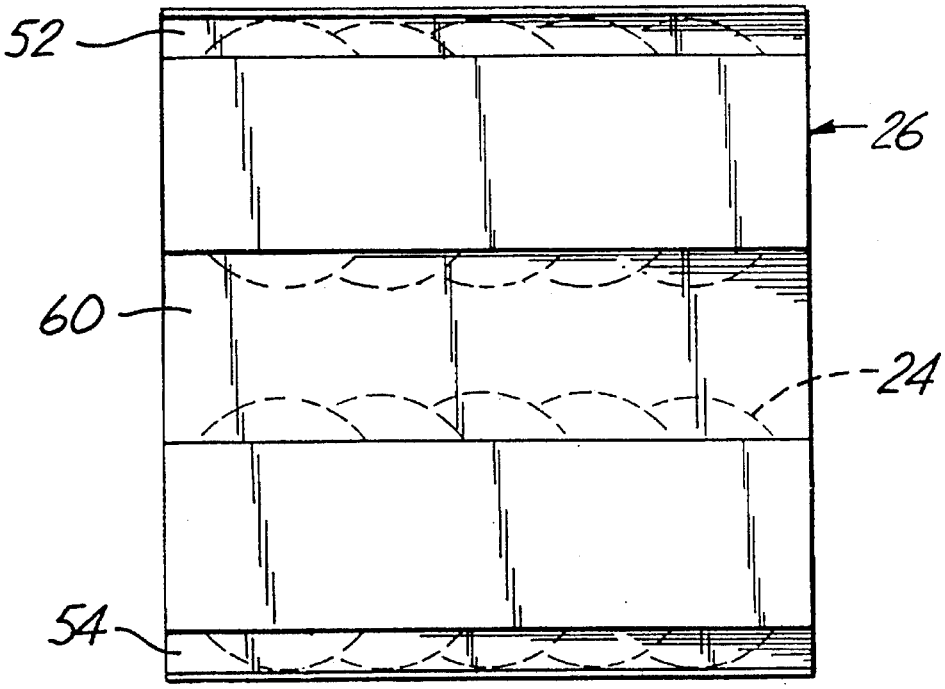
FIG. 16 is a bottom plan.

FIG. 16 is a rear view of the disc support structure 26 illustrating the media discs 24 extending through the slots (see FIGS. 9 and 10) so that edges of the discs 24 extend into the edge buffers 52, 54 and center buffer 60. It will be understood that the two rows 62, 64 represent an exemplary embodiment, and that the number of rows, and the number of discs per row, may vary without departing from the scope of the present invention.

Figure 18:
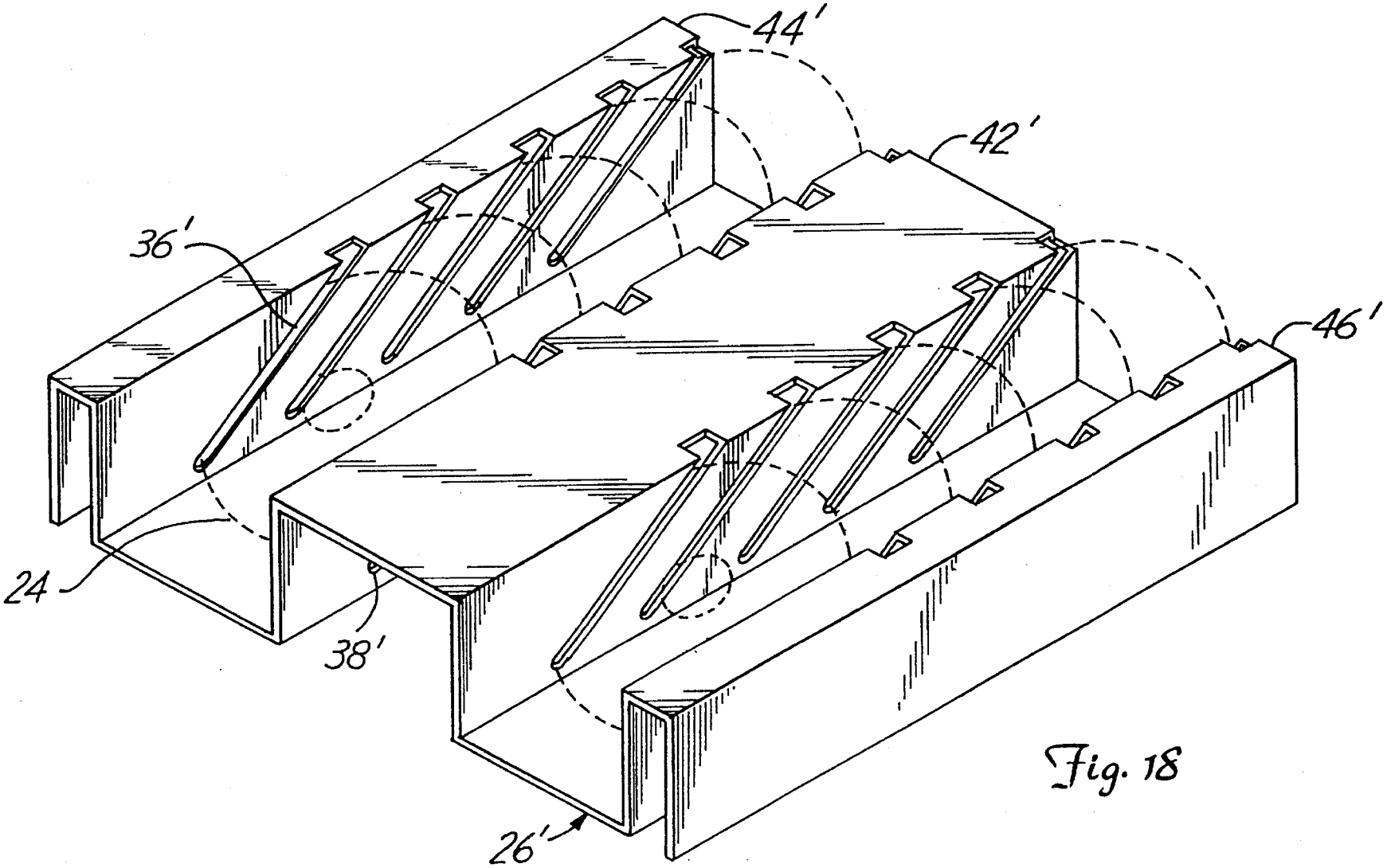
FIG. 18 is an alternate disc support structure.

In an alternate embodiment illustrated in FIG. 18, slots 36', 38' may partially extend through the middle support 42' and edge portions 44', 46' to facilitate insertion of the discs 24 into, and removal from, the disc support structure 26'.

Turning back to FIGS. 9 and 10, edge portions 44, 46 may be formed adjacent to the opposing side walls 32, 34', respectively. Outer sides 48, 50 may optionally be attached to the edge portions 44, 46, respectively, to help maintain the edge portions 44, 46 in a generally orthogonal relationship to the opposing side walls 32, 34'.

The edge portions 44, 46 form first and second edge buffers 52, 54 which serve a shock absorbing function for the media discs 24 during transport and handling. A center buffer 60 is formed by the opposing side walls, 32', 34 and the middle support 42. The center buffer provides additional shock absorbing protection for the discs 24.

Figure 12:
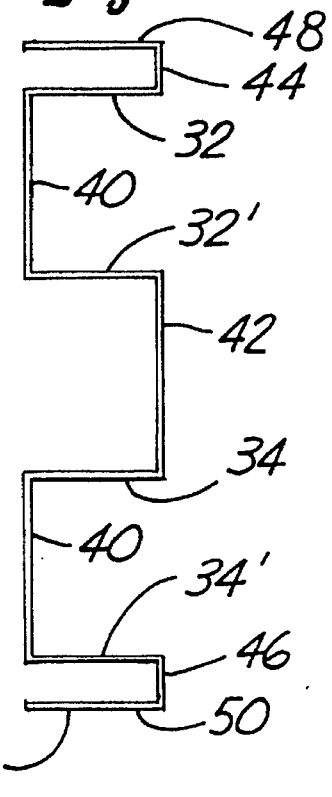
FIG. 12 is a side elevation as seen from bottom to top of FIG. 11.
Figure 13:
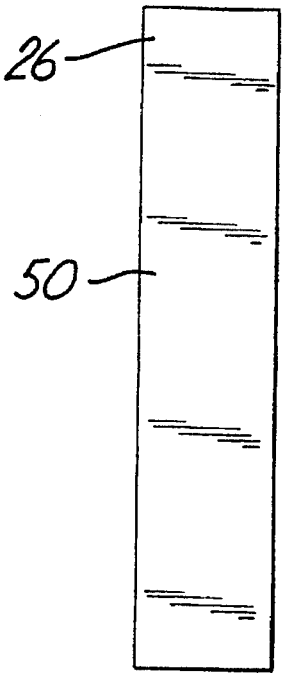
FIG. 13 is a side elevation as seen from the side opposite that shown in FIG. 12.

FIGS. 11 through 14 are side views of the disc support structure 26. As is illustrated in FIG. 12, the opposing side walls 32, 32', 34, 34' and outer sides 48, 50 are generally parallel, and orthogonal to the edge portions 44, 46, the middle support 42, and the back walls 40, respectively. However, it will be understood that the present invention is not limited to this configuration. In particular, the disc support structure 26 may be stretched along an axis "s" to create an angular relationship between the various walls.

Figure 17:
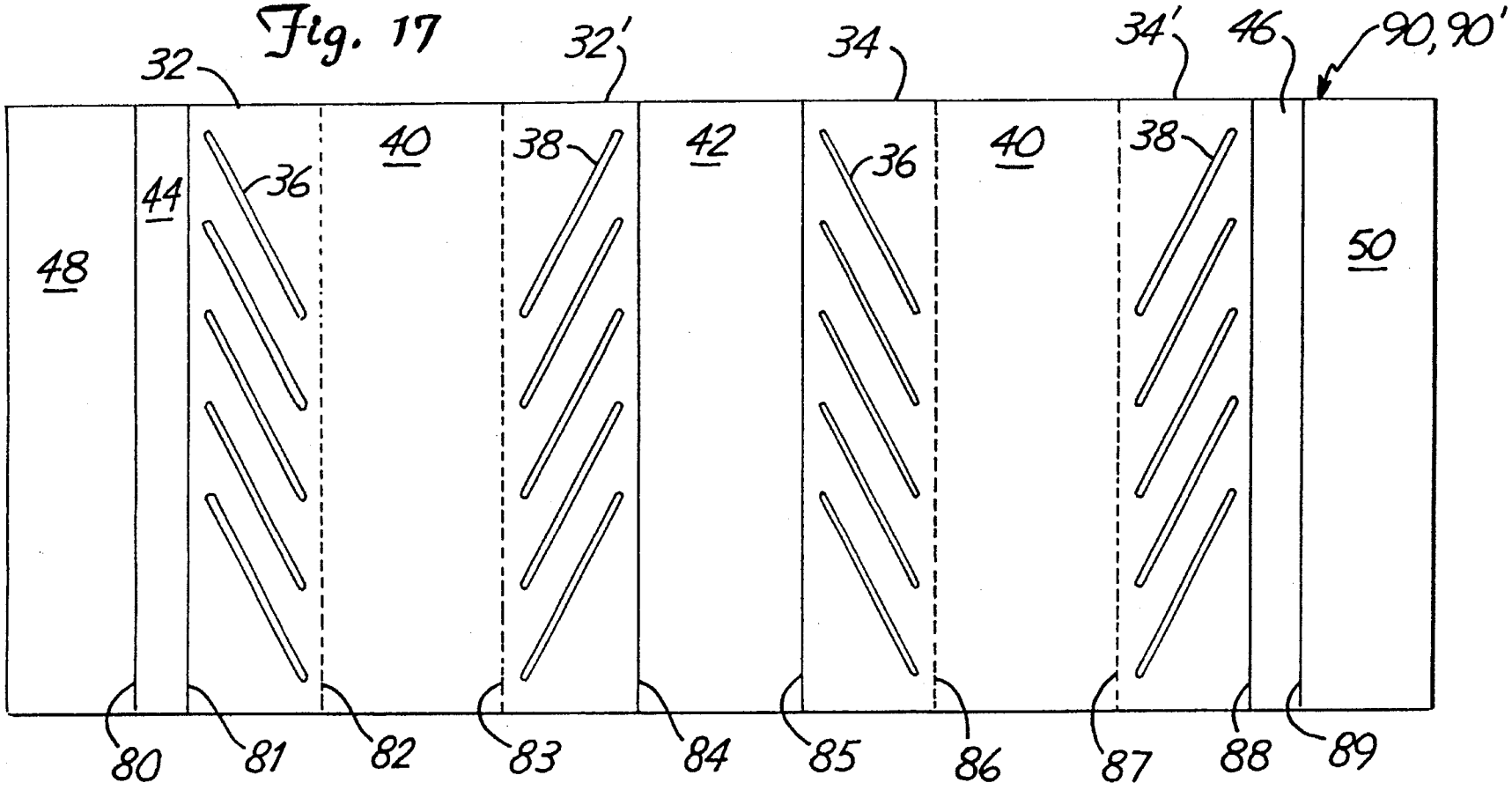
FIG. 17 is a generated view of a sheet material prior to formation of a disc support structure.

FIG. 17 is a generated view of an exemplary sheet material prior to formation of the disc support structure 26. A method for manufacturing the disc container includes locating a plurality of forming lines 80, 81, 82, 83, 84, 85, 86, 87, 88, 89 on sheet material 90 corresponding to the location and spacing of the opposing side walls 32, 32', 34, 34', back walls 40, middle support 42, edge portions 44, 46, and outer sides 48, 50. Slots 36, 38 are then cut or stamped into the sheet material 90. Finally, the sheet material is formed along the forming lines 80–89 into the disc support structure 26 discussed above.

It will be understood that the sheet material 90 may be composed of cardboard, plastic, or any other suitable semi-rigid material. If the sheet material 90 is constructed of cardboard, it may be desirable to score the forming lines 80–89 to facilitate a folding operation. Alternatively, a plastic sheet material 90' may be vacuum formed, stamped, or thermally deformed to create the structure illustrated in FIGS. 9 and 10. After formation, discs 24 are inserted into the slots 36, 38. The entire disc support structure 26 may optionally be inserted into the outer housing 22.

The present invention has now been described with reference to several embodiments thereof. It will be apparent to those skilled in the art that many changes can be made in the embodiments described without departing from the scope of the invention. Thus, the scope of the present invention should not be limited to the structure described herein, but only by structures described in the language of the claims and the equivalence of those structures.

What is claimed is:

1. A disc container for simultaneously retaining and displaying a plurality of media discs comprising:

a disc support structure including;

at least one pair of opposing walls separated a fixed distance;

a display plane through which at least a portion of the plurality of media discs is viewable;

at least one pair of laterally aligned, opposing slots extending through the at least one pair of opposing walls, respectively, for receiving and retaining edge portions of a media disc, the pair of opposing slots being arranged relative to a display plane so that the plurality of media discs are retainable in an angular relationship relative to the display plane and a portion of a surface of each of the plurality of media discs is visible through the display plane; and an outer housing extending substantially around the disc support structure, the outer housing having a rear wall, a front wall having a transparent display window generally coplanar with the display plane, and a plurality of perimeter walls, the at least one pair of opposing slots being offset from the outer housing by edge portions so that a portion of the plurality of media discs may extend therethrough beyond the at least one pair of opposing walls.

2. A disc container for simultaneously retaining and displaying a plurality of circular media discs, comprising:

a sheet material formed into a disc support structure, the disc support structure comprising:

at least one pair of opposing walls each having front and back edges;

a back wall attached to the at least one pair of opposing walls proximate the back edges so that the walls are separated a fixed distance;

a display plane extending generally parallel to the front edges of the at least one pair of opposing walls;

a pair of edge portions forming edge portions proximate the at least one pair of opposing walls;

at least one pair of laterally aligned opposing slots extending through the at least one pair of opposing walls, respectively, for receiving edge portions of a media disc, the pair of opposing slots being arranged relative to a display plane so that the plurality of media discs are retainable in an angular relationship relative to the display plane and a portion of a surface of each of the plurality of media discs is visible through the display plane; and an outer housing extending substantially around the disc support structure, the outer housing having a rear wall generally coplanar with the back wall, a front wall having a transparent display window generally coplanar with the display plane, and a plurality of perimeter walls, the at least one pair of opposing slots being offset from the housing by edge portions so that a portion of the plurality of media discs may extend through the at least one pair of laterally aligned, opposing slots beyond the at least one pair of opposing walls.

3. The apparatus of claim 2 wherein the back wall is orthogonal to the at least one pair of opposing walls.

4. A disc container for simultaneously retaining and displaying a plurality of circular media discs comprising:

a disc support structure including;

at least one pair of opposing walls separated by a fixed distance;

a plurality of pairs of slots extending through the at least one pair of opposing walls, respectively, for receiving and retaining edge portions of a media disc, the pain of slots being arranged relative to a display plane so that the plurality of media discs are retainable in an angular relationship relative to the display plane and so that a portion of a surface of each of the plurality of media discs is visible through the display plane; and an outer housing extending substantially around the disc support structure, the outer housing having a front wall with a transparent display window for viewing the plurality of media discs generally coplanar with the display plane, the from wall having an external surface coplanar with the display window, the at least one pair of opposing slots being offset from the outer housing by edge portions so that a portion of the plurality of media discs may extend through the plurality of pairs of opposing slots beyond the at least one pair of opposing walls.

5. A disc container for simultaneously retaining and displaying a plurality of circular media discs comprising:

disc retaining means having at least one pair of opposing walls separated by a fixed distance, the opposing walls having disc engaging means for receiving and retaining portions of the plurality of circular media discs in a fixed angular relationship relative to a display plane so that a portion of a surface of each of the plurality of media discs is visible through the display plane; and an outer housing extending substantially around the disc retaining means, the outer housing having a front wall generally coplanar with the display plane with a transparent display window for viewing the plurality of media discs, the front wall further having an opaque portion coplanar with the display window and the disc engaging means being offset from the outer housing by edge portions.

6. The apparatus of claims 1, 2, 4 or 5 wherein the angular relationship comprises retaining each of the plurality of media discs at the same angle relative to the display plane.

7. The apparatus of claims 1, 2 or 4 wherein a portion of the front wall has an opaque external surface generally coplanar with the transparent display window.

8. The apparatus of claims 1, 2, 4 or 5 wherein the transparent display window comprises a generally rectangular shape.

9. The apparatus of claims 1, 2, 4 or 5 wherein the opposing walls are generally parallel.

10. The apparatus of claims 1, 2, 4 or 5 wherein the at least one pair of opposing walls comprises a two pairs of generally opposing walls.

11. The apparatus of claims 1, 2 or 4 wherein the at least one pair of opposing walls each have front and back edges, the opposing slots extending only a portion of a distance to the front and back edges.

12. The apparatus of claims 1, 2, 4 or 5 wherein the at least one pair of opposing side walls comprises a deformed sheet material.

13. The apparatus of claim 1, 2, 4 or 5 wherein a material for constructing the at least one pair of opposing side walls is selected from a group comprising paper board or plastic.

14. The apparatus of claims 1, 2 or 4 further comprising at least one media disc.

* * * * *